United States Patent [19]

Fenner, Sr.

[11] Patent Number: 5,022,111

[45] Date of Patent: Jun. 11, 1991

[54] PRESSURE REDUCTION MATTRESS

[75] Inventor: William G. Fenner, Sr., Richmond, Va.

[73] Assignee: E. R. Carpenter Company, Inc., Richmond, Va.

[21] Appl. No.: 545,522

[22] Filed: Jun. 29, 1990

[51] Int. Cl.[5] ..... A47C 27/15

[52] U.S. Cl. ..... 5/481; 5/464

[58] Field of Search ..... 5/464, 468, 481

[56] References Cited

U.S. PATENT DOCUMENTS

| | | | |
|---|---|---|---|
| D. 308,453 | 6/1990 | Elrod . | |
| 2,902,091 | 9/1959 | Dahle . | |
| 3,047,888 | 8/1962 | Shecter et al. | 5/481 |
| 3,051,601 | 8/1962 | Schick | 5/464 X |
| 3,118,153 | 1/1964 | Hood | 5/464 X |
| 3,197,357 | 6/1965 | Schulpen . | |
| 3,846,857 | 11/1974 | Weinstock | 5/464 |
| 3,939,508 | 2/1976 | Hall et al. | 5/464 |
| 4,064,578 | 12/1977 | Yamada . | |
| 4,320,543 | 3/1982 | Dixon . | |
| 4,335,476 | 6/1982 | Watkin . | |
| 4,580,301 | 4/1986 | Ludman et al. | 5/464 |
| 4,603,445 | 8/1986 | Spann . | |
| 4,620,337 | 11/1986 | Williams . | |
| 4,673,452 | 6/1987 | Awdhan | 5/481 X |
| 4,686,724 | 8/1987 | Bedford . | |
| 4,700,447 | 10/1987 | Spann . | |
| 4,741,058 | 5/1988 | Williams . | |
| 4,816,494 | 3/1989 | Watson, Jr. et al. . | |

FOREIGN PATENT DOCUMENTS

| | | |
|---|---|---|
| 1729995 | 8/1971 | Fed. Rep. of Germany . |
| 1281638 | 5/1962 | France . |
| 526407 | 12/1954 | Italy . |

OTHER PUBLICATIONS

Omalux (TM) foam brochure of E. R. Carpenter date ???.

Iris 10,000 brochure of E. R. Carpenter, 4/89.

Ostomy/Wound Management, vol. 26, Jan./Feb. 1990.

*Primary Examiner*—Michael F. Trettel

*Attorney, Agent, or Firm*—Beveridge, DeGrandi & Weilacher

[57] ABSTRACT

A laminated foam mattress for reducing or relieving the pressure exerted against a user of the mattress. The matress includes an upper and a lower layer of polyurethane foam each of which is laminated to a middle layer of a different polyurethane foam. The upper and lower layers feature a polyurethane foam which is of a higher density than the middle layer. The upper and lower layers also include a higher initial softness ratio than the middle layer. The middle layer has higher 5, 25 and 65% indentation load deflection values (ILD) than the corresponding ILD values for the upper and lower layers which is attributable to the firm support provided by the middle layer. The middle layer is preferably about twice as thick as the upper and lower layers. The upper and lower layers each include a checkerboard-like upper surface. The combination of layers provides for a reduction in pressure points especially in those areas most susceptible to skin ulcers such as the hip and heel. The combination of layers work together to provide firm, comfortable support while distributing loads both between the individual and the upper layer and between the lower layer and the underlying support structure.

20 Claims, 2 Drawing Sheets

PRESSURE REDUCTION MATTRESS

FIELD OF THE INVENTION

This invention relates to a mattress. More particularly, the present invention is directed at a laminated foam mattress which is designed to relieve or reduce the pressure exerted on the body of a person lying on the mattress.

BACKGROUND OF THE INVENTION

For patients and other persons restricted to bed for extended periods of time, there arises the possibility of decubitus ulcers forming. Decubitus ulcers (also referred to as bed sores, pressure sores or pressure ulcers) are formed due to an interruption of blood flow in the capillaries below skin tissue due to pressure against the skin.

The highest risk areas for such ulcers to form are those areas where there exists a bony prominence which tends to shut down capillaries sandwiched between the bony prominence and the underlying support surface. When considering the redistribution of body weight and the formation of decubitus ulcers, the trochanter (hip) and the heels are the body sites of greatest concern since these two areas are most frequently involved in decubitus ulcer formations.

Blood flows through the capillaries at approximately 32 millimeters of mercury pressure (mm Hg). This level can be somewhat lower for elderly individuals or individuals with poor health or nutritional deficiencies. Thus, for the most part, once an external pressure exceeds 32 mm Hg, capillary occlusion occurs and the capillaries no longer supply oxygen and nutrition to the skin. Therefore, tissue trauma sets in with the resultant tissue decay and ulcer formation. Movement of the individual into different positions helps in restoring blood circulation into the effected areas. Such movement is, however, not always possible or, in some instances, neglected.

Moreover, even for shorter rest periods and healthy individuals a mattress which does not relieve or reduce the pressure exerted on the user is not likely to be considered to be comfortable. On the other hand, a mattress which does not provide sufficient firmness or support is also likely to be considered uncomfortable.

Various devices are relied upon by medical personnel and the like in attempting to avoid the problem of decubitus ulcers in bedridden individuals and provide greater user comfort. For instance, air mattress overlays, air mattresses (static and dynamic), water mattress overlays, water mattresses, gel-like overlays, specialty care beds, foam overlays and various types of other mattresses have been introduced in an attempt to avoid the above noted problems with decubitus ulcers and general user discomfort.

The prior art foam overlays in combination with a mattress and the prior art specialty mattresses, suffer from many drawbacks including:

(1) insufficient pressure reduction, especially in the hip and heel area;
(2) poor body/foam conformance which can lead to poor weight distribution and the development of high pressure points;
(3) discomfort due to rigid foam or easily "bottomed out" pads;

(4) the placement of the person too high above the underlying mattress so as to decrease user safety and limit user mobility;
(5) high heat retention within the surface of the foam overlay;
(6) difficulty in the positioning of sheet and bed cover material; and
(7) the possibility of having the overlay shift out of place with respect to the underlying mattress.

Furthermore, mattress overlays can be economically burdensome as the pads often cost an additional $150 to $200 above and beyond the cost of the underlying mattress. Thus, a hospital or the like which is required to replace a large number of mattresses (e.g. 5,000) would require a large expenditure (e.g. $750,000 at $200 per overlay). Also the mattress overlays are likely to require replacement before a mattress would require replacement. Thus, a plurality of replacement mattress overlays would likely be required during the life of the underlying mattress.

SUMMARY OF THE INVENTION

The present invention provides a laminated foam mattress which provides for a reduction and a relief of the pressure exerted on a user lying on the mattress. In addition, the mattress of the present invention provides for enhanced body/foam comformance while achieving a firm and comfortable support of the user without high heat retention and high shear forces developing. Further, the present invention avoids the height problem created by stacking an overlay over a conventional mattress as well as the sheet and cover fitting problems associated with an overlay. Also, the present invention, with respect to mattress overlays, allows for higher cost savings.

The foam mattress of the present invention is in the form of a triple layer laminated mattress having a middle layer formed of a first type of polyurethane foam and an upper and lower layer formed of a second type of polyurethane foam, the combination of which provides for a mattress which avoids the above noted problems associated with the prior art mattresses and mattress overlays. In other words, the three layers forming the laminated mattress work in conjunction to provide enhanced comfort and a reduction or relief in pressure on the user.

The upper and lower layers are formed of a high-resiliency densified urethane foam preferably having a density ranging between 2.3 to 2.7 lbs/ft$^3$. The bottom of the upper layer is preferably affixed to the upper surface of the middle layer by an adhesive and generally is less thick than the middle layer. Similarly, the upper surface of the lower layer is preferably secured to the bottom surface of the middle layer with adhesive and is less thick than the base layer. For example, a middle layer thickness which is twice as thick as the upper and lower layers has proven suitable for the purposes of the present invention.

In addition to having a higher density than the base layer, the upper and lower layers also have a higher initial softness ratio than the base layer. The combination of high density and high initial softness ratio enables the more problematic body parts such as the heel to sink into the foam before load resistance is encountered. This arrangement increases the body-to-foam contact area and spreads the weight of the body part over a greater area thereby reducing the pressure on the body part (e.g., heel).

The upper and lower layers also have a lower indentation load deflection at the 5, 25 and 65% deflection points than the corresponding indentation load deflection values of said middle layer. This results in the middle layer being firmer than the external layers and less soft to the touch. In a preferred embodiment the upper and bottom layers are formed of the same thickness, of the same material and of the same dimensions. The mattress can thus be flipped over and still provide the advantageous support and comfort. Suprisingly, the above noted characteristics of the present invention result in similar if not improved pressure readings when compared with prior art foam overlay and conventional mattress combinations.

The use of two external layers with higher initial softness ratios, higher density, and lower ILD values than the middle layer also adds to user comfort. While the upper layer closely conforms and reduces the pressure applied against the person lying on the bed, the bottom layer closely conforms to the supporting bed frame structure and helps distribute the pressure so as to reduce the tendency for upward forces to pass through the middle layer, through the upper layer and to the individual.

To reduce the contact area while maintaining sufficient support, the upper and lower layers preferably include a plurality of depressions or recesses which extend partially but not completely through the layer in which the recesses are formed. The depressions or recesses are arranged so as to form a checkerboard-like surface in the upper and lower layers. This arrangement, as opposed to having the recesses extend through to the base layer, is preferred as the maintenance of an interconnecting layer of the more dense and softer foam amongst the plurality of protuberances is believed to improve the distribution of the forces over the surface of the mattress. In other words, the more dense foam material is believed to better pass along the forces than would an arrangement where the less dense and firmer middle layer provided the interconnecting layer.

A suitable polyurethane foam for forming the upper and lower layers includes the polyurethane foam sold under the trademark OMALUX as described in U.S. Pat. No. 4,816,494 which is incorporated herein by reference.

The portions of the upper and lower layers between the depressions are planar so as to provide an overall planar support surface on the top surface of the upper layer.

The middle layer is formed of a polyurethane foam having a density ranging generally between about 1.80 to 2.00 lbs/ft$^3$ and a compression modulus of between 1.90 to 2.10. A suitable polyurethane foam material for forming the base layer includes H39XG foam which is a foam sold by E.R. Carpenter Company, Inc. of Richmond, Va.

DETAILED DESCRIPTION OF A PREFERRED EMBODIMENT

Figure 1:
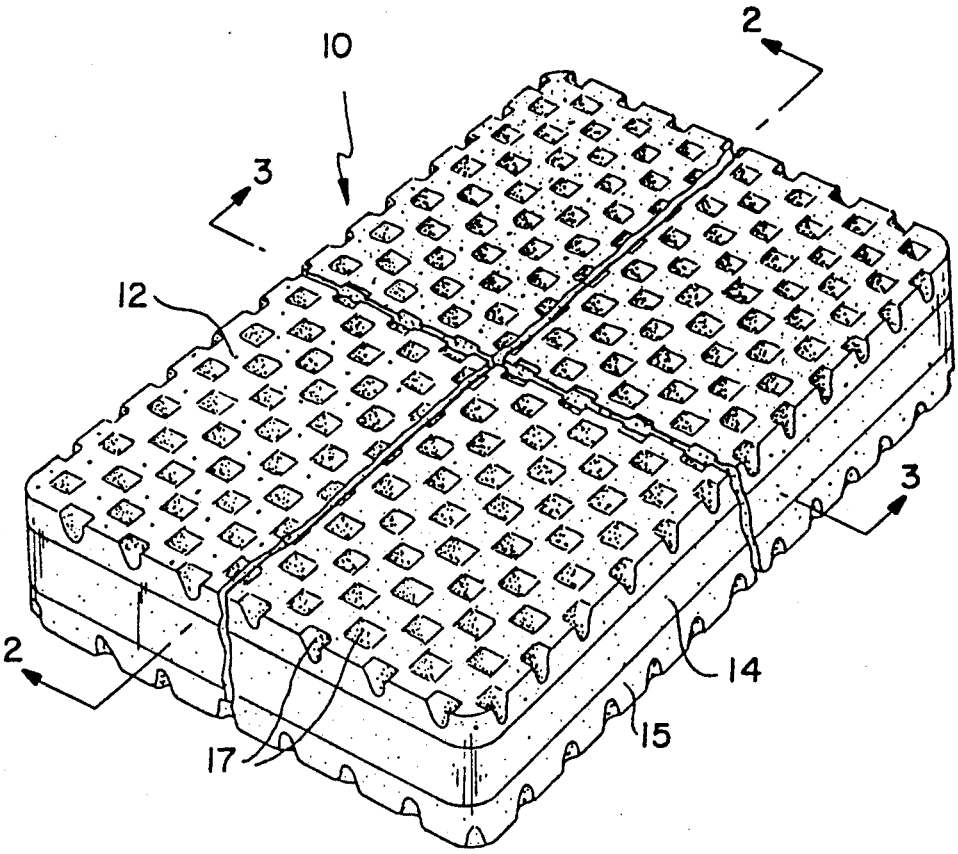
FIG. 1 illustrates a perspective view of a preferred embodiment of the present invention.

FIG. 1 shows, in perspective, a preferred embodiment of the present invention. As shown in FIG. 1, mattress 10 includes an upper layer 12 affixed to the upper surface of middle layer 14. FIG. 1 also shows lower layer 15 having its upper surface affixed to the lower surface of middle layer 14.

Both the upper layer, lower layer and middle layer are formed of a polyurethane foam material with the upper and lower layer's foam material being formed of a first type of polyurethane foam and the middle layer being formed of a second type of polyurethane foam. The upper and lower layers are preferably formed of a homogeneous polyurethane foam such as that described in U.S. Pat. No. 4,816,494. The density of the upper and lower layers are preferably about equal and the density of the upper and lower layers is higher than the density of the middle layer. Preferably the density of the upper and lower layers are within the range of about 2.0–2.7 lbs/ft$^3$ and more preferably about 2.3–2.7 lbs./ft$^3$ and even more preferably about 2.5 lbs/ft$^3$.

The material forming the upper and lower layers also provides Indentation Load Deflection (ILD) values for 5, 25 and 65% deflection points which are lower than the corresponding ILD values for the middle layer. The ILD value represents the amount of displacement force required to displace a pad a predetermined percentage (e.g. 5, 25 and 65%) of the pads' total thickness. Thus a foam pad having an ILD value of 14 for a deflection of 25% would require a load of 14 lbs to deflect a 4 inch thick pad 1 inch.

The upper and lower layers of the present invention preferably have an ILD value that falls within the range of 4 to 9 for a deflection of 5% between 11 to 21 for a deflection of 25% and 30 to 70 for a deflection of 65%.

The upper and lower layers also are formed so as to have an initial softness ratio which falls within the range of about 2.4 to 3.0. The softness ratio is determined by taking the ratio of the ILD value for 25% deflection over the ILD value for 5% deflection. In a preferred embodiment, the upper and lower layers have a softness ratio of 2.7.

Moreover, the upper and lower layers are designed to have a compression modules which lies within the range of about 2.7 to 3.3. The compression modulus reflects the bottoming resistance of a pad and is determined by the ratio of the foam layer's ILD value for 65% deflection taken over the ILD value for 25% deflection. In the present invention, a preferred compression modules for the upper and lower layers is about 2.9.

The middle layer is formed of a second type of polyurethane foam having a density which is lower than that of the upper and lower layers. For example, in a preferred embodiment the middle layer is formed of a pad having a density falling within the range of about 1.8 to 2.0 and more preferably 1.8 to 1.9 lbs/ft$^3$.

The ILD values for 5, 25 and 65% deflection are higher for the middle layer than that of the corresponding deflection percentages for the upper and lower layers. The middle layer is preferably formed of a foam material having a 5% ILD value falling between 26 to 38; a 25% ILD value falling between 39 to 49; and a 65% ILD value falling between 70 to 105. In the most preferred embodiment, the 5, 25 and 65% ILD values for the middle layer are 36, 43 and 90, respectively.

Correspondingly, the initial softness ratio for the middle layer falls between 1.3 to 1.5 and, most preferably, is about 1.4.

Also, the middle layer is formed of a foam material exhibiting a compression modules which falls within the range of 1.9 to 2.1 and, most preferably, is about 2.0.

Figure 3:
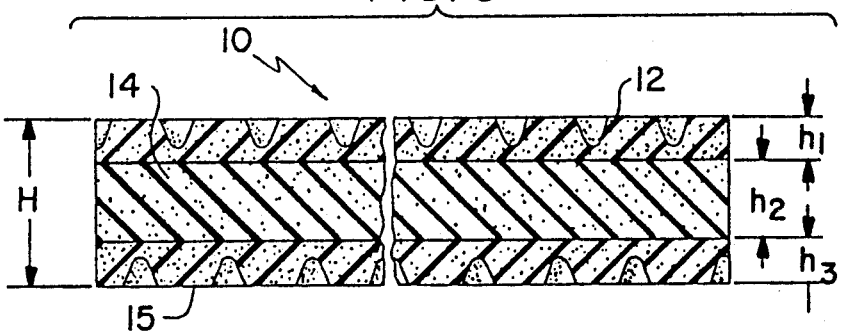
FIG. 3 shows a cross-sectional view along line II—II of the embodiment shown in FIG. 1.

Referring to FIG. 3, there is illustrated the respective thicknesses of the upper, lower and middle layers. As shown, the middle layer is preferably made of greater thickness than that of the upper and lower layers. In achieving the most complimentary relationship between the upper, lower and middle layer, it is preferable that the ratio of the middle layer thickness $h_2$ over the upper layer thickness $h_1$ or the middle layer thickness $h_2$ over the lower layer thickness $h_3$ be within the range of about $1\frac{3}{4}$:$1\frac{1}{4}$ to $2\frac{1}{4}$:$\frac{3}{4}$ and most preferably 2:1. This latter ratio is obtained by using the most preferred height value of $1\frac{1}{2}$" for $h_1$ and $h_3$, and 3" for $h_2$ which results in the total thickness H of mattress 10 being about 6".

Figure 2:
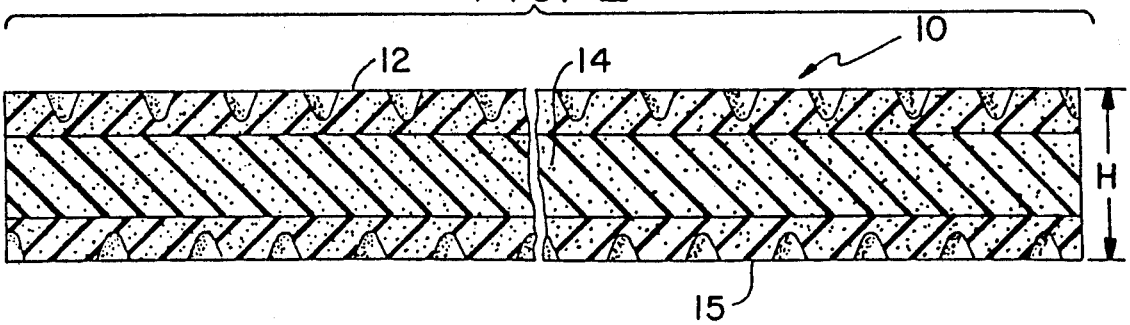
FIG. 2 shows a cross-sectional view along line I—I of the embodiment shown in FIG. 1.
Figure 4:
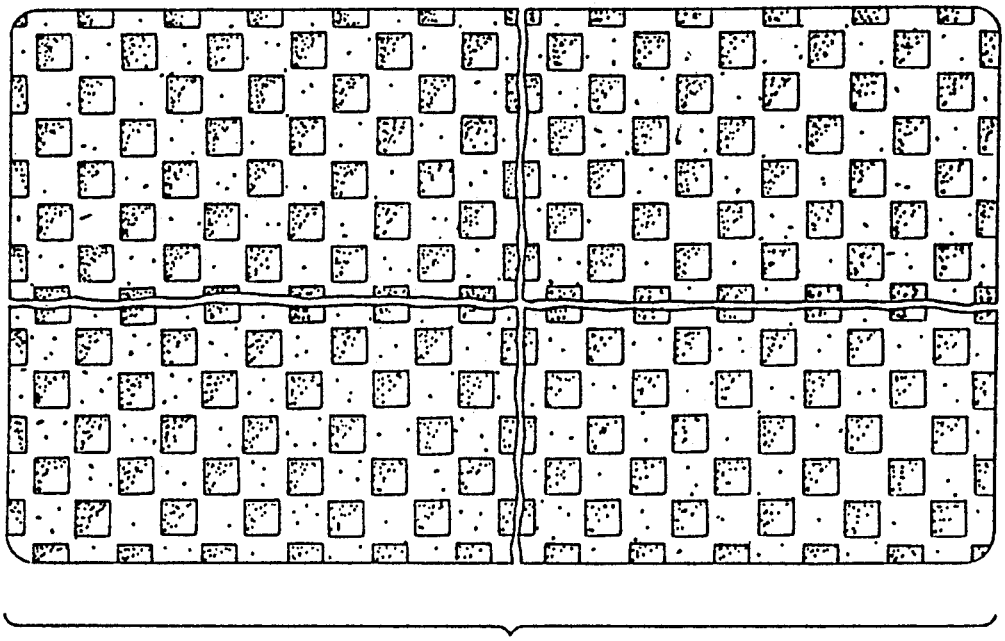
FIG. 4 shows a planar view of either the top or bottom of the mattress as both views are visually the same.
Figure 5:
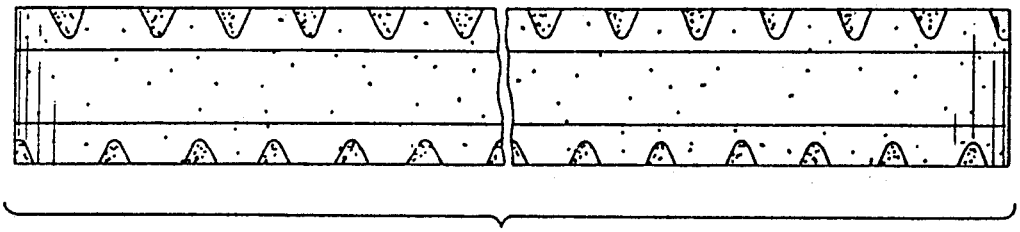
FIG. 5 shows a side view of the mattress.
Figure 6:
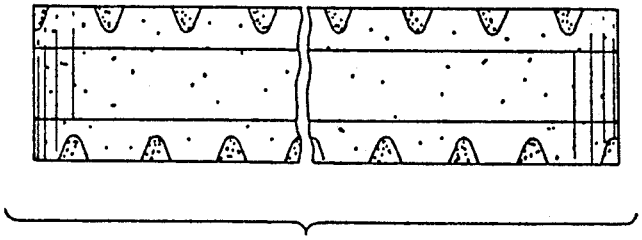
FIG. 6 shows an end view of the mattress.

As shown in FIGS. 1–2, depressions 16 are formed so as not to extend entirely through upper layer 12 and into base layer 14. Further, it is preferred to have the depressions extend into the upper or lower layer for about 50% of the entire thickness of the layer in which the recess or depression is formed. The depressions are placed serially both along the length and width of the mattress 10. The depressions are also spaced so as to place protruberances 17 in a checkerboard-like arrangement on the upper surface of the upper and lower layers. This arrangement minimizes the surface contact between the body of the user and upper planar surface 18 of upper layer 12. The protruberances preferably constitute about 60% of the total planar surface. The protruberances also have a length (l)/width (w) configuration of about 1" to 1".

The depressions can be formed in any of the techniques common in the art including convoluted rollers, molding, heat slicing, punch disc, etc.

To illustrate the advantages of the present invention over various foam mattresses in the prior art, the following tables contain test data obtained by the independent Twin City Testing Corporation located at 662 Cromwell Avenue Saint Paul, Minn.

The tables below document the results of pressure point testing carried out on a mattress having essentially the same characteristics as the aforementioned most preferred characteristics. The mattress which was tested had a total thickness of about $6\frac{1}{2}$" with the middle layer being essentially double the thickness of the two equal thickness outer layers. The outer layers were formed of the aforementioned OMALUX (TM) foam material while the middle layer was formed of the aforementioned H39XG foam material sold by E. R. Carpenter Company, Inc. The total dimensions of the mattress was $6\frac{1}{2}$"×36"×80" with a weight of 19 pounds.

The procedure for testing the mattress involved the use of a Talley Oxford Pressure Monitor-Model MK II for the evaluation. The mattress was placed on the floor and subjects, selected according to specific weight ranges, were positioned on top. The subjects were all dressed in the same cotton sweat suits with no shoes to ensure the proper placement of the sensor.

The subjects weight and height are listed below:

A - 185 lbs. - 5'10"

-continued

B - 110 lbs. - 5'2"
C - 170 lbs. - 5'10"

Five pressure areas were measured with three replications obtained and the results averaged and reported below. The five test areas were as follows:

1. Heel
2. Head
3. Scapula (shoulder blade)
4. Sacral Prominence (tailbone)
5. Trochanter (hip)

TABLE I

| TEST RESULTS | All Values in mm Hg-Average of Three Replications |
|---|---|
| 185 lbs. - 5'10" | |
| Heel | 20 |
| Head | 33 |
| Scapula | 22 |
| Sacral Prominence | 30 |
| Trochanter | 31 |
| 110 lbs. -5'2" | |
| Heel | 21 |
| Head | 26 |
| Scapula | 23 |
| Sacral Prominence | 27 |
| Trochanter | 40 |
| 170 lbs. - 5'10" | |
| Heel | 19 |
| Head | 28 |
| Scapula | 19 |
| Sacral Prominence | 26 |
| Trochanter | 37 |

TABLE II

| TEST RESULTS SUMMARY | Avg. of All Replications and Subjects Values in mm Hg |
|---|---|
| Heel | 20 |
| Head | 29 |
| Scapula (shoulder blade) | 21 |
| Sacral Prominence (tailbone) | 28 |
| Trochanter (hip) | 36 |

As noted previously, it is generally believed that any external or internal forced applied to bony prominences of greater than 32 mm Hg can attribute to capillary shutdown and the formation of skin ulcers. It is thus desirable to keep the pressure in these areas, especially the hip and heel, as close to or below the 32 mm Hg level. As the test results indicate, the present invention is successful at maintaining the pressure on the user close to and well below the 32 mm Hg level.

Although the present invention has been described with reference to a preferred embodiment, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A mattress, comprising:

a first layer of polyurethane foam material having a density of from about 2.30 to 2.70 lbs./ft$^3$, said first layer having an upper surface and a lower surface;

a second layer of polyurethane foam material having a density of from about 1.80 to 2.00 lbs/ft$^3$, said second layer having an upper surface and a lower surface with the upper surface of said second layer being secured to the lower surface of said first layer;

a third layer of polyurethane foam material having a density of from about 2.30 to 2.70 lbs/ft$^3$, said third layer having an upper and a lower surface with said upper surface secured to the lower surface of said second layer; and said second layer having a higher indentation load deflection value than said first and said third layer.

2. A mattress as recited in claim 1 wherein said first and third layers are formed of the same material and are essentially equal in thickness.

3. A mattress as recited in claim 2 wherein said second layer is essentially twice as thick as the individual thickness of said first and third layers.

4. A mattress as recited in claim 3 wherein said second layer is about 3 inches in thickness and said first and third layers are about 1.5 inches in thickness.

5. A mattress as recited in claim 1 wherein said first and third layers have a compression modulus ratio falling between about 2.70:1 to 3.3:1.

6. A mattress as recited in claim 5 wherein said first and third layers have 5% indentation load deflection between about 4 to 9, a 25% indentation load deflection between about 11 to 21 and a 65% indentation load deflection between about 30 to 70, and said second layer has a 5% indentation load deflection between about 26 to 38, a 25% indentation load deflection between about 39 to 49 and a 65% indentation load deflection between about 70 to 105.

7. A mattress as recited in claim 1 wherein said first and third layers have an initial softness ratio of between about 2.4:1 to 3.0:1.

8. A mattress as recited in claim 1 wherein said first and third layers have 5% indentation load deflection between about 4 to 9, a 25% indentation load deflection between about 30 to 70, and said second layer has a 5% indentation load deflection between about 26 to 38, a 25% indentation load deflection between about 39 to 49 and a 65% indentation load deflection between about 70 to 105.

9. A mattress as recited in claim 8 wherein said first and third layers have an initial softness ratio of between about 2.4:1 to 3.0:1.

10. A mattress as recited in claim 1 wherein said first and third layers have a compression modules of 2.7 or more and said second layer has a compression modules of less than 2.3.

11. A mattress as recited in claim 1 wherein the upper surface of said first layer and the lower surface of said third layer each have a plurality of depressions formed therein and said depressions being arranged in checkerboardlike fashion and each depression extending about 50% of the total thickness of the layer in which the depression is formed.

12. A mattress, comprising:

a first layer formed of polyurethane foam having a 5% indentation load deflection between about 4 to 9, a 25% indentation load deflection between about 11 to 21 and a 65% indentation load deflection between about 30 to 70, said first layer having an upper and a lower surface;

a second layer of polyurethane foam material having a 5% indentation load deflection between about 26 to 38, a 25% indentation load deflection between about 39 to 49 and a 65% indentation load deflection between about 70 to 105, said second layer having an upper surface secured to the lower surface of said first layer and a lower surface;

a third layer of polyurethane foam material having a 5% indentation load deflection between about 4 to 9, a 25% indentation load deflection between about 11 to 21 and a 65% indentation load deflection between about 30 to 70, said third layer having an upper surface secured to the lower surface of said second layer as well as a lower surface.

13. A mattress as recited in claim 12 wherein said first and third layers are formed of the same material and are essentially equal in thickness.

14. A mattress as recited in claim 12 wherein said second layer is essentially twice as thick as the individual thickness of said first and third layers.

15. A mattress as recited in claim 12 wherein said first and third layers have a compression modulus ratio falling between 2.7:1 to 3.3:1 and said base layer has a compression modulus ratio falling between about 1.9:1 to 2.1:1.

16. A mattress as recited in claim 12 wherein said first and third layers have an initial softness ratio between about 2.4:1 to 3.0:1.

17. A mattress as recited in claim 12 wherein said first and third layers feature a plurality of depressions formed therein and said depressions are arranged in checkerboard-like fashion with each depression extending about 50% of the total thickness of the layer in which the depression is formed.

18. A mattress, comprising:

a first layer formed of a foam material, said first layer having an upper surface and a lower surface;

a second layer formed of a foam material, said second layer having an upper surface and a lower surface, and the upper surface of said second layer being secured to the lower surface of said first layer;

a third layer formed of a foam material, said third layer having an upper surface and a lower surface with the upper surface of said third layer being secured to the lower surface of said second layer;

said first and third layers having a higher density and initial softness ratio than said second layer, and said first and third layers having lower indentation load deflection values than said second layer for deflections at 5, 25 and 65 percent;

said first layer having a plurality of depressions formed in the upper surface of said first layer, said third layer having a plurality of depressions formed in the lower surface of said third layer, and the depressions formed in said first and third layers are arranged in a checkerboard-like sequence.

19. A mattress, as recited in claim 18 wherein the depressions formed in said first and third layers extend for about 50% of the thickness of the layer in which the depressions are formed.

20. A mattress, comprising:

a first layer of foam material having a density value and an indentation load deflection value;

a second layer of foam material secured to said first layer and having a density value and an indentation load deflection value;

a third layer of foam material secured to said second layer and having a density value and an indentation load deflection value;

said indentation load deflection value of said first and said third layer being lower than the indentation load deflection value of said second layer; and said density value of said first and said third layer being higher than the density value of said second layer.

* * * * *